US005150648A

United States Patent [19]

Okada et al.

[11] Patent Number: 5,150,648

[45] Date of Patent: Sep. 29, 1992

[54] METHOD AND APPARATUS FOR DETECTING PRINT-TERMINATION IN LINE PRINTER

[75] Inventors: Kenji Okada; Tsukasa Ogawa, both of Ibaraki, Japan

[73] Assignee: Hitachi Koki Co., Ltd., Tokyo, Japan

[21] Appl. No.: 540,235

[22] Filed: Jun. 19, 1990

[30] Foreign Application Priority Data

Jun. 23, 1989 [JP] Japan ..... 1-161782

[51] Int. Cl.[5] ..... B41J 1/20

[52] U.S. Cl. ..... 101/93.14

[58] Field of Search ..... 400/146; 101/93, 13, 101/93.14

[56] References Cited

FOREIGN PATENT DOCUMENTS 54971 3/1986 Japan ..... 400/314.1

61-38037 8/1986 Japan ..... 101/93.14

OTHER PUBLICATIONS

Abstract of 55-154,675.

*Primary Examiner*—David A. Wiecking

*Assistant Examiner*—Steven S. Kelley

*Attorney, Agent, or Firm*—Sughrue, Mion, Zinn, Macpeak & Seas

[57] ABSTRACT

A print-termination detecting apparatus and method for a line printer with which it is possible to accurately predict the termination of printing so as to shorten the paper feeding cycle and to thereby make it possible to attain higher speed printing. Based on the fact that the termination of printing can be predictively detected X columns earlier by anticipatory comparison with respect to a character which will come X columns after a currently opposite character, a pre-scanning flag for storing the result of the anticipatory comparison is provided wherein, when all the columns of the pre-scanning flag indicate "no print data", it is recognized that printing has been terminated, whereupon the paper feeding cycle is started. X is determined taking into consideration the dead time in the paper-feeding system including a paper-feeding motor, the time required for comparison/collation, and the flight time of the respective print hammer.

18 Claims, 7 Drawing Sheets

METHOD AND APPARATUS FOR DETECTING PRINT-TERMINATION IN LINE PRINTER

BACKGROUND OF THE INVENTION

The present invention relates to a print-termination detecting method and apparatus for a line printer of a type employing a character carrier, such as a character band, which continuously moves along a print line.

As is well known, such a line printer is configured so that printing is carried out by alternately repeating a printing cycle and a paper feeding cycle including a data receiving cycle for receiving print data and paper-feed data. In the printing cycle, a comparing operation is carried out to judge whether or not a character on a character carrier agrees with a print datum according to which a print hammer column is to perform printing. When the character accords with the print datum, a print hammer on a column corresponding to the print datum is driven to perform printing. In general, the printing speed may be increased if both the printing cycle and the paper feeding cycle are shortened. However, current designs have reached a limitation so that it is difficult to further shorten those cycles. Accordingly, further improvements in printing speed cannot be expected merely by increasing the printing cycle and the paper feeding cycle.

To obtain yet further improvements, there has been proposed, as disclosed, for example, in commonly assigned Japanese Patent Examined Patent Publication No. 61-38037, a printer in which, based on the fact that a dead time exists between the time of issuing a paper feeding instruction and the time of actually starting the motion of paper, a paper feeding instruction is issued immediately before the termination of printing cycle to thereby shorten the paper feeding cycle. Such a printer in shown in FIG. 2.

According to this proposal, a paper feeding instruction is based issued on an estimation that the printing cycle is finished when a comparing operation has been repeated a predetermined number of times. However, such estimation often becomes impossible when the pattern of print data changes. Further, such estimation becomes invalid when a parity error or the like occurs. Consequently, there are a large number of drawbacks in practical use.

SUMMARY OF THE INVENTION

Accordingly, an object of the present invention is to eliminate the aforementioned drawbacks in the prior art and to thereby make it possible to accurately predict the termination of printing so as to shorten the paper feeding cycle and to thereby make it possible to attain higher speed printing.

The present invention is based on the fact that the termination of printing can be predictively detected X columns earlier by anticipatory comparison with respect to a character which will come X columns after a currently opposite character. According to the invention, a pre-scanning flag for storing the result of the anticipatory comparison is provided wherein, when all the columns of the pre-scanning flag exhibit "no print data", it is recognized that printing has been terminated, whereupon the paper feeding cycle is started. In accordance with the invention, X is determined taking into consideration the dead time in the paper-feeding system including a paper-feeding motor, the time required for comparison, and the flight time of the respective print hammer.

DESCRIPTION OF THE PREFERRED EMBODIMENTS

Preferred embodiments of the present invention will be now described with reference to the drawings. For convenience in description, it is assumed that one printed line of characters is composed of 136 columns and that a character band of 48 characters is used as a character carrier. Further, it is assumed that whenever the character band is shifted by one character, comparison for 136 columns is carried out, and that comparison is defined as one scanning in which five subsidiary scannings are carried out.

Figure 3:
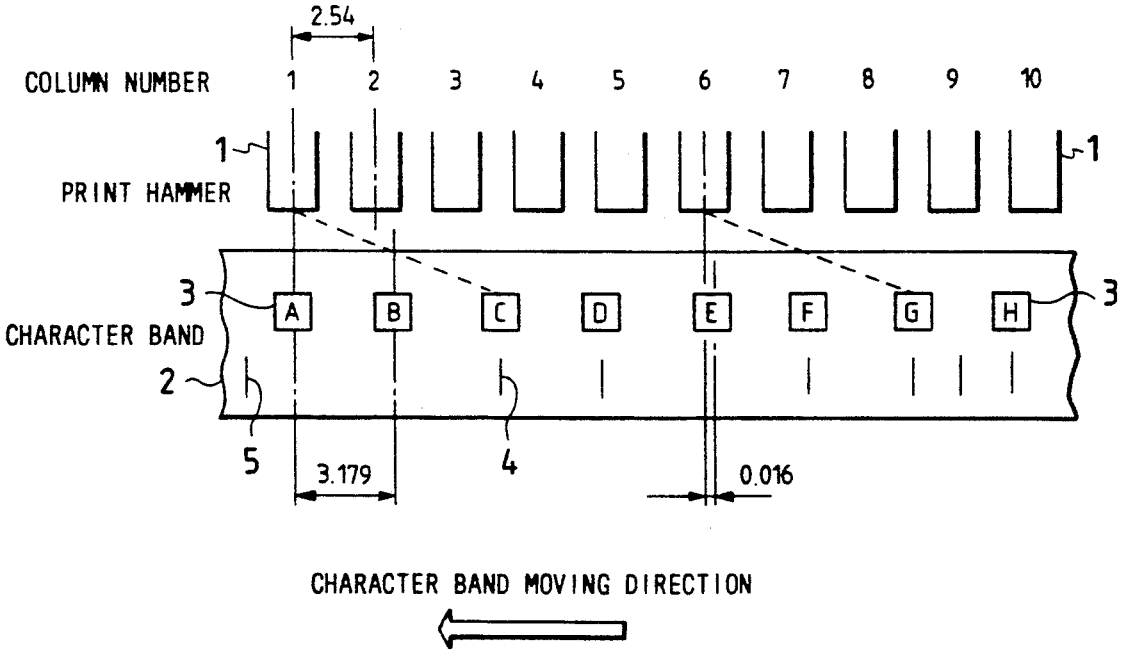
FIG. 3 is a view for explaining the relationship between the column of the print hammer and the character band.

Assuming now that the print hammers 1 and the character band 2 are disposed so as to be in opposition to each other as shown in FIG. 3, and that the character number of a character 3 (A in FIG. 3) corresponding to the first-column print hammer 1 is defined as "1", the respective columns of the print hammers 1 and the respective character numbers of the characters 3 are compared with each other in the subsidiary scannings as shown in Table 1. In Table 1, the print hammer columns and the character numbers are read out in rightward order in Table 1 with the passage of time.

Figure 1:
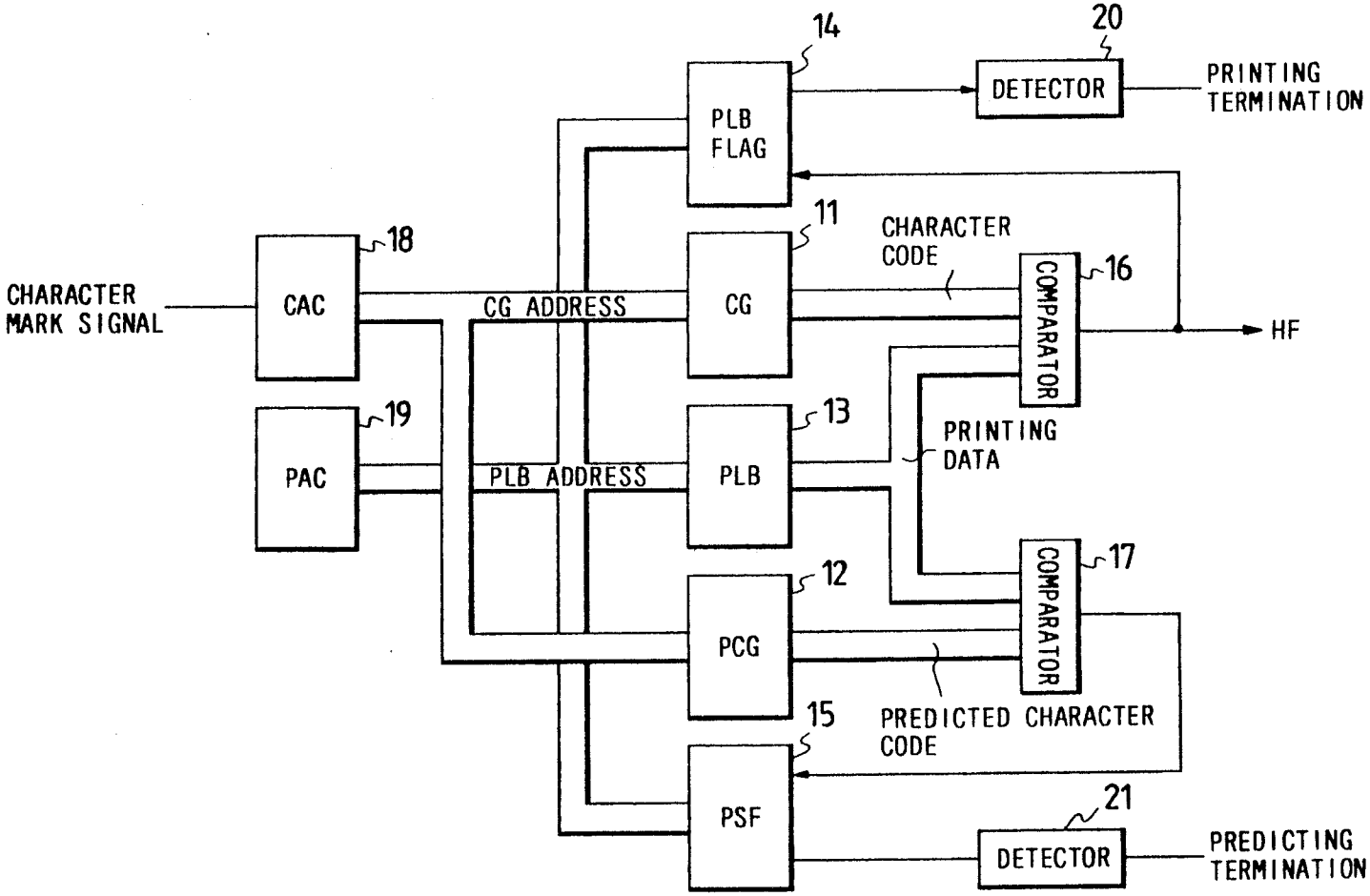
FIG. 1 is a block diagram of a preferred embodiment of an apparatus according to the present invention.
Figure 2:
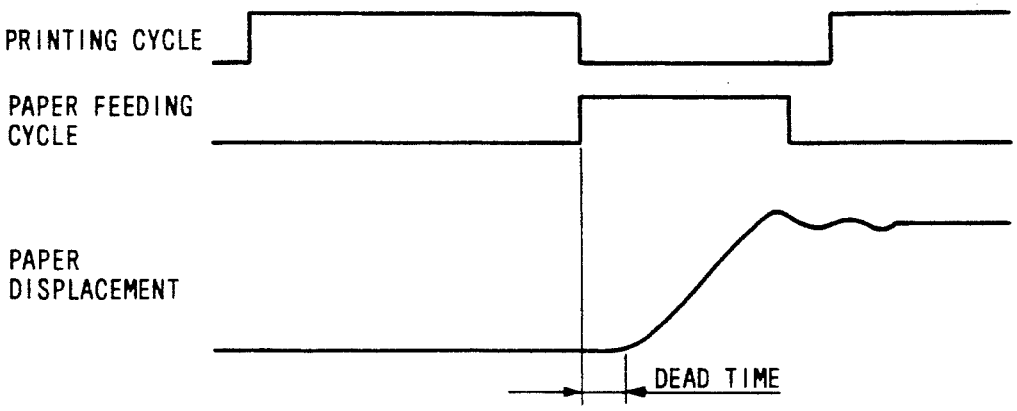
FIG. 2 is a view for explaining the relationship among the printing cycle, paper feeding cycle and amount of paper displacement.

FIG. 1 is a block diagram showing an embodiment of the present invention. A code generator (hereinafter abbreviated to "CG") 11 stores character codes in the order in accordance with the arrangement of the characters on the character band 2 and feeds to a comparator 16 a character code corresponding to an address designated by a code address counter (hereinafter abbreviated to "CAC") 18. The CAC 18, which serves to designate addresses of the CG 11 in the order shown in Table 1, includes a character position counter (not shown) which serves to count pulses of a character mark signal generated when the character mark 4 is detected. Further, the CAC 18 receives a predetermined number of pulses generated at the time of the start of subsidiary scannings except the first subsidiary scanning. The aforementioned configuration is well known, for example, from commonly assigned Japanese Unexamined Patent Publication No. 59-52678.

A print line buffer (hereinafter abbreviated to "PLB") 13 for storing print data transferred from a host computer (not shown) feeds the comparator 16 with a print datum corresponding to an address designated by a PLB address counter (hereinafter abbreviated to "PAC") 19. The PAC 19 designates addresses of the PLB 13 in the order shown in Table 1. The configuration of the PAC 19 is commonly shown as well as the CAC 18.

A PLB flag 14 having a storage area of 136 columns per line is configured so that information indicating presence/absence of print data is written at addresses corresponding to o those of the PLB 13 when the print data are transferred to the PLB 13. When, for example, print data are present, a "1" is written, and when print data are absent, a "0" is written. Access to the PLB flag 14 as well as the PLB 13 is made by the PAC 19. The output of the PLB flag 14 is fed to a termination detector 20. When all the columns of the PLB flag 14 exhibit absence of print data, the detector 20 recognizes the termination of printing.

The comparator 16 compares character codes supplied from the CG 11 with print data supplied from the PLB 13. When the character codes and the print data accord with each other, the comparator 16 feeds a drive signal HF to a hammer drive circuit (not shown) and, at the same time, the comparator 16 feeds a signal to the PLB flag 14 to rewrite the corresponding columns of the PLB flag 14 to "0", which indicates "absence of print data".

Figure 5:
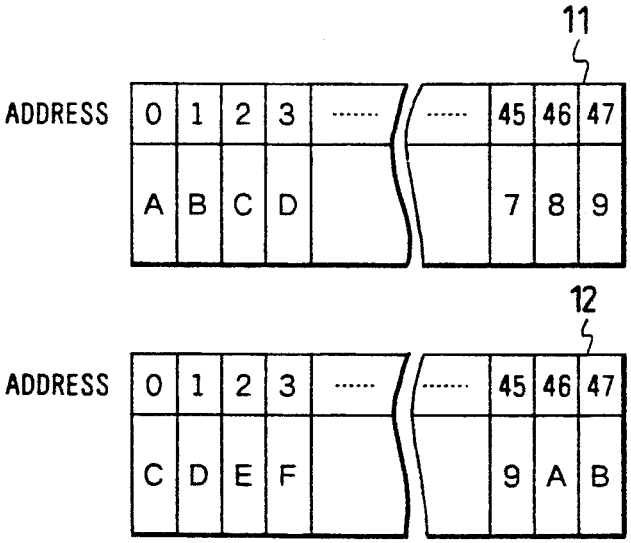
FIG. 5 is a view showing characters stored in the code generator and predicting code generator in FIG. 1.

Access to a predicting code generator (hereinafter abbreviated to "PCG") 12 as well as the CG 11 is made by the CAC 18., The PCG 12 stores the predicting code of a character which will come X columns after a current character. Assuming now that X is 2 and that the current character which is in opposition to the first print hammer 1 is "A" as shown in FIG. 3, then the character to be read from the PCG 13 is "C", which is two columns after "A" although the character read from the CG 11 is "A". In short, characters respectively stored in the CG 11 and PCG 12 are as shown in FIG. 5. A character which will come two columns after is stored in the address of the PCG 12 corresponding to the address of the CG 11.

Figure 4:
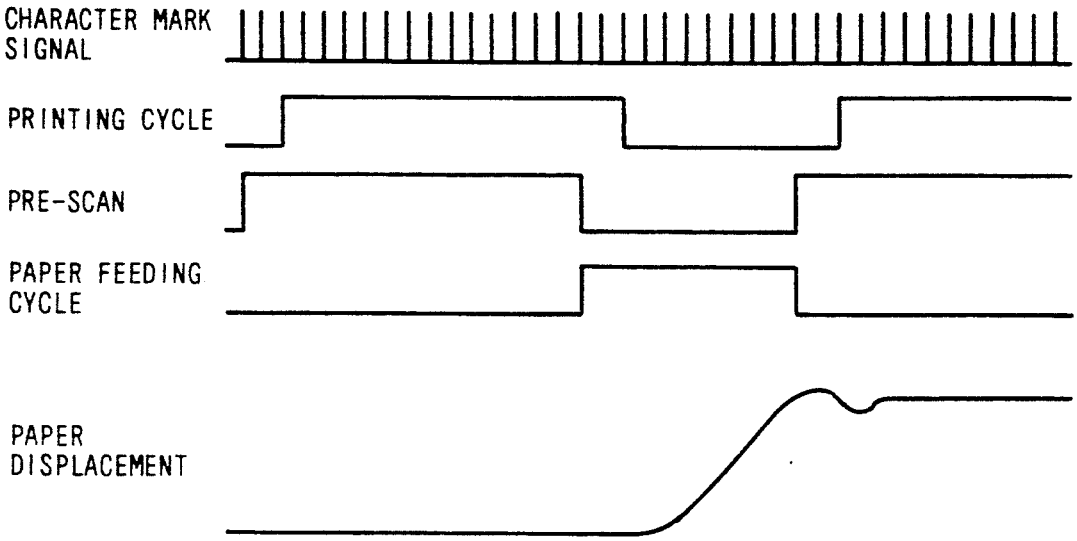
FIG. 4 is a timing chart for explaining the operation of the apparatus according to the invention.

The character data of the PCG 12 and the print data of the PLB 13 are fed to an anticipatory comparator 17. When the character data and the print data accord with each other, the anticipatory comparator 17 feeds a signal to a pre-scanning flag (hereinafter abbreviated to "PSF") 15 to rewrite the contents of a corresponding column of the PSF 15 to "0" to indicate "absence of print data". The PSF 15 and the PLB flag 14 are configured so that information indicating the presence/absence of print data is written at the address corresponding to that of the PLB 13 when the print data is transferred to the PLB 13. A pre-scanning termination detector 21 is similar to the termination detector 20. When all the columns of the PSF 15 are "0", the pre- scanning termination detector 21 predictively recognizes the termination of printing. The anticipatory comparator 17 is configured so that its comparing operation starts based on a character mark signal which is two columns prior to the actual print cycle, and that its comparator operation stops based on a character mark signal which is two columns prior to the print cycle as shown in FIG. 4.

Accordingly, the anticipatory comparator 17 performs comparison with respect to the predicting character which comes two columns after the current character, and the anticipatory comparator 17 rewrites the contents of the corresponding column of the PSF 15 to "0" when the print data and the predicting character code accord with each other. Accordingly, the termination of printing can be predictively detected by the pre-scanning termination detector 21.

If the paper feeding cycle is started based on the output of the pre-scanning termination detector 21, the motion of the paper can be started just at the time of termination of printing or, in other words, just at the time when the termination detector 20 recognizes the termination of printing. As a result, the paper feeding cycle can be shortened to thereby attain high-speed printing.

According to the aforementioned embodiment, the termination of printing can be accurately predicted by the pre-scanning termination detector 21 so that the paper feeding cycle can be shortened to thereby attain high-speed printing. However, the anticipatory comparator 17 must start earlier than the comparator 16 by two pulses of the character mark signal. There arises a problem in that the printing operation starting control becomes somewhat complex. If the anticipatory comparator 17 and the comparator 16 are operated at the same time, the termination of printing cannot be predicted exactly. This is because two characters at the time of the starting of the printing operation are out of the anticipatory comparison, and, accordingly, the termination detector 20 may detect the termination of printing earlier than the pre-scanning termination detector 21.

Table 2 is provided for the purpose of simplification of above description and shows actual print data. The fact that the PLB flag 14 is rewritten to "0" to indicate "absence of print data" when a character facing a print hammer column accords with the print data and the fact that the PSF 15 is rewritten to "0" when the anticipatory comparator 17 makes a decision that a character read from the PCG 12 accords with the print data, are shown in Table 2 at every scanning period. Although the actual printing is performed in six scannings, all the columns of the PSF 15 are rewritten to "0"after four scannings. In short, as is obvious from Table 2, the termination of printing can be predictively detected so speedily as to be shortened by two scannings.

In the case where the print data is as shown in Table 3, the termination detector 20 can detect the termination of printing in four scannings, whereas the pre-scanning termination detector 20 cannot predictively detect the termination of printing in only four scannings. In short, the termination of printing cannot be predictively detected by the pre-scanning termination detector 21.

Figure 6:
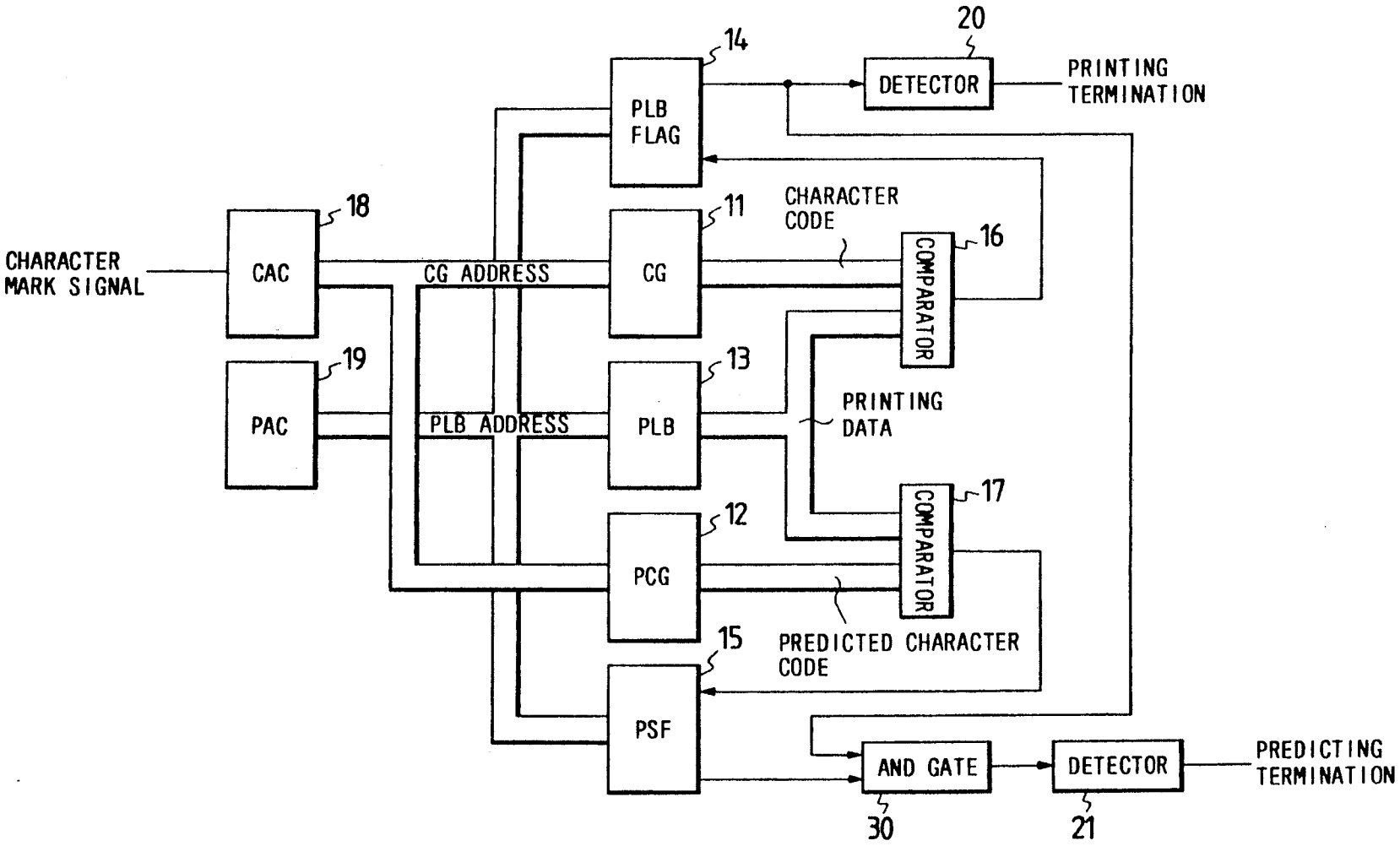
FIGS. 6 through 9 are block diagrams showing other embodiments of the invention.
Figure 7:
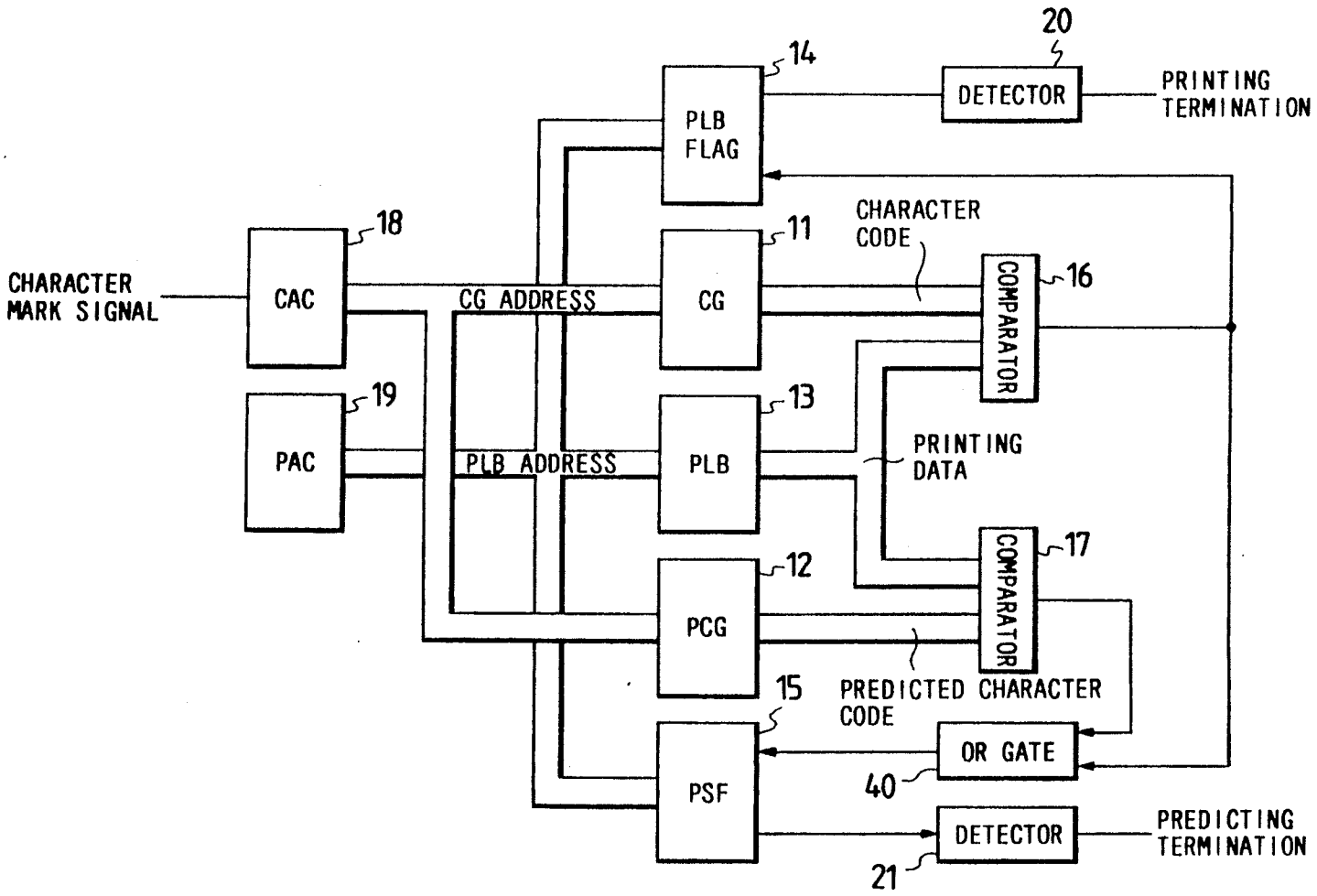

FIGS. 6 and 7 respectively illustrate measures which can be taken to overcome the above drawback so that the termination of printing can be securely predictively detected by the pre-scanning termination detector 21. In FIG. 6, the output of every column of the PLB flag 14 and the output of every column of the PSF 15 are fed to the pre-scanning termination detector 21 through an AND gate 30. When any one of the output signals of the PLB flag 14 and the PSF 15 is "0" indicating "absence of print data", the AND gate 30 outputs a signal "0".

In FIG. 7, signals produced by the comparator 16 and the anticipatory comparator 17 to indicate no print data are applied to the PSF 15 through an OR gate 40, so that the corresponding column of the PSF 15 is rewritten. As is consequently obvious from Tables 2 and 3, the termination of printing can be accurately predictively detected by the pre-scanning termination detector 21 regardless of the print data.

Figure 8:
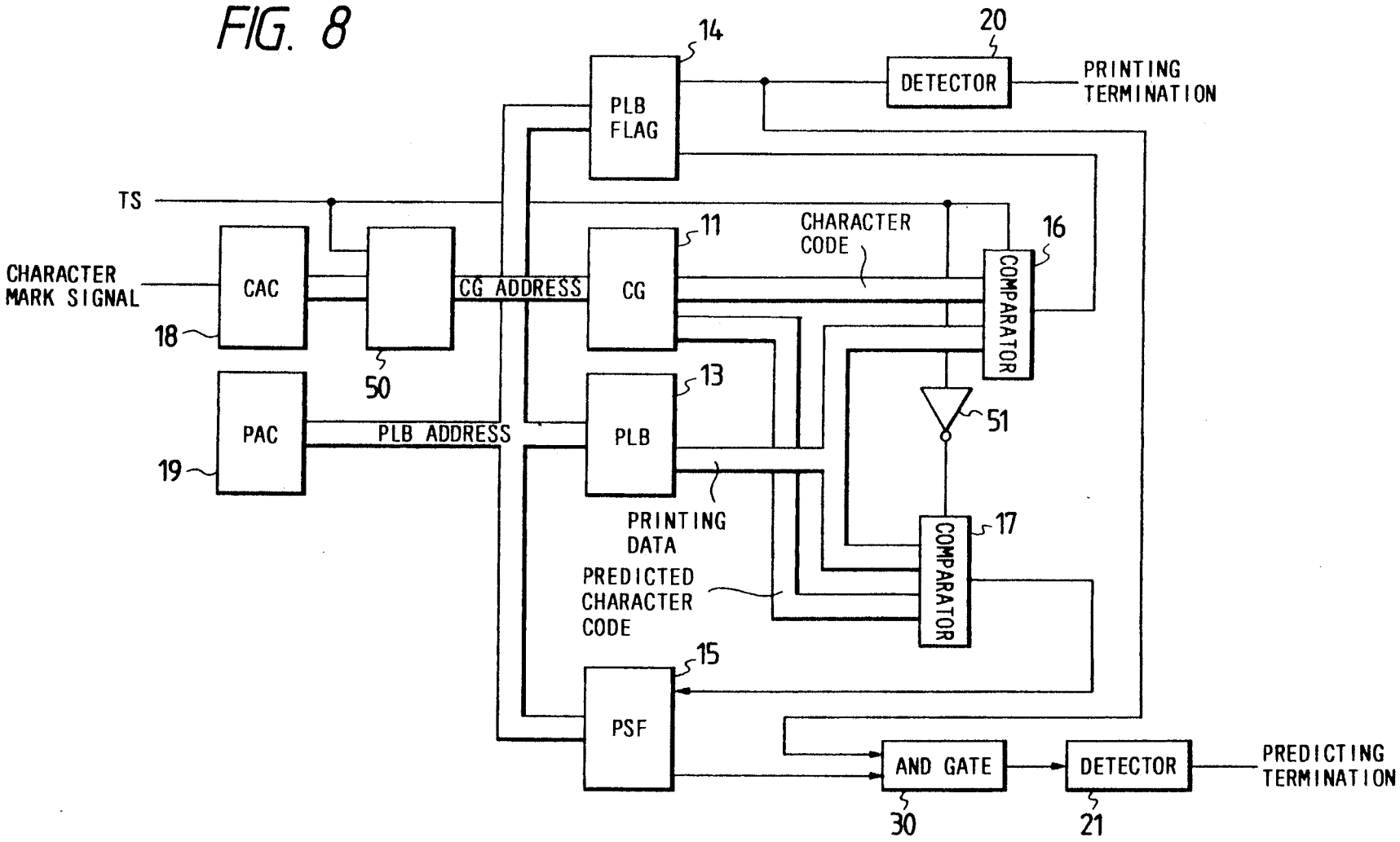

In the aforementioned embodiments, a PCG 12, which is substantially equivalent to the CG 11, is required, so that the PCG 12 is complex in construction. FIG. 8 illustrates how to overcome such a problem. In FIG. 8. time division is used for selecting one from a current character which is currently in opposition to the print hammer and a predicting character which will come two columns after the current character. As a result, the PCG 12 used in the aforementioned embodiments can be removed. In short, an adder 50 is provided between the CAC 18 and the CG 11. The operation of the adder is switched based on a time-divisional signal TS which periodically takes a theoretical value "1" during a predetermined time at the time in the printing cycle, so that one of the comparator 16 and the anticipatory comparator 17 can be selectively operated based on the time-divisional signal TS. In short, when the time-divisional signal TS is at a theoretical value "0", the adder 50 directly feeds the address data of the CAC 18 to the CG 11 with no addition. When the time-divisional signal TS is at a theoretical value "1", the adder 50 adds X, for example, 2, to the address data of the CAC 18 and feeds the result of the addition to the CG 11 to thereby issue a code of a character code two columns after the current character and feeds the character code to the anticipatory comparator 17. The output of every column of the PLB flag 14 and the output of every column of the PSF 15 are fed to the pre-scanning termination detector 21 through the AND gate 30 in the same manner as in the aforementioned embodiment shown in FIG. 6.

As a result, this embodiment has the same effect as that of the embodiment in FIG. 6. In short, the termination of printing can be accurately predicted by the pre-scanning termination detector 21 so that the paper feeding cycle can be shortened. According to this embodiment, the PCG 12 can be eliminated, and hence the apparatus can be simplified in construction.

In the embodiment of FIG. 8, although the apparatus can be simplified in construction because the PCG 12 used in the aforementioned embodiments can be eliminated, there is still a problem in that the character code of the CG 11 and the print data of the PLB 13 must be fed to the anticipatory comparator 17 for the purpose of anticipatory comparison.

Figure 9:
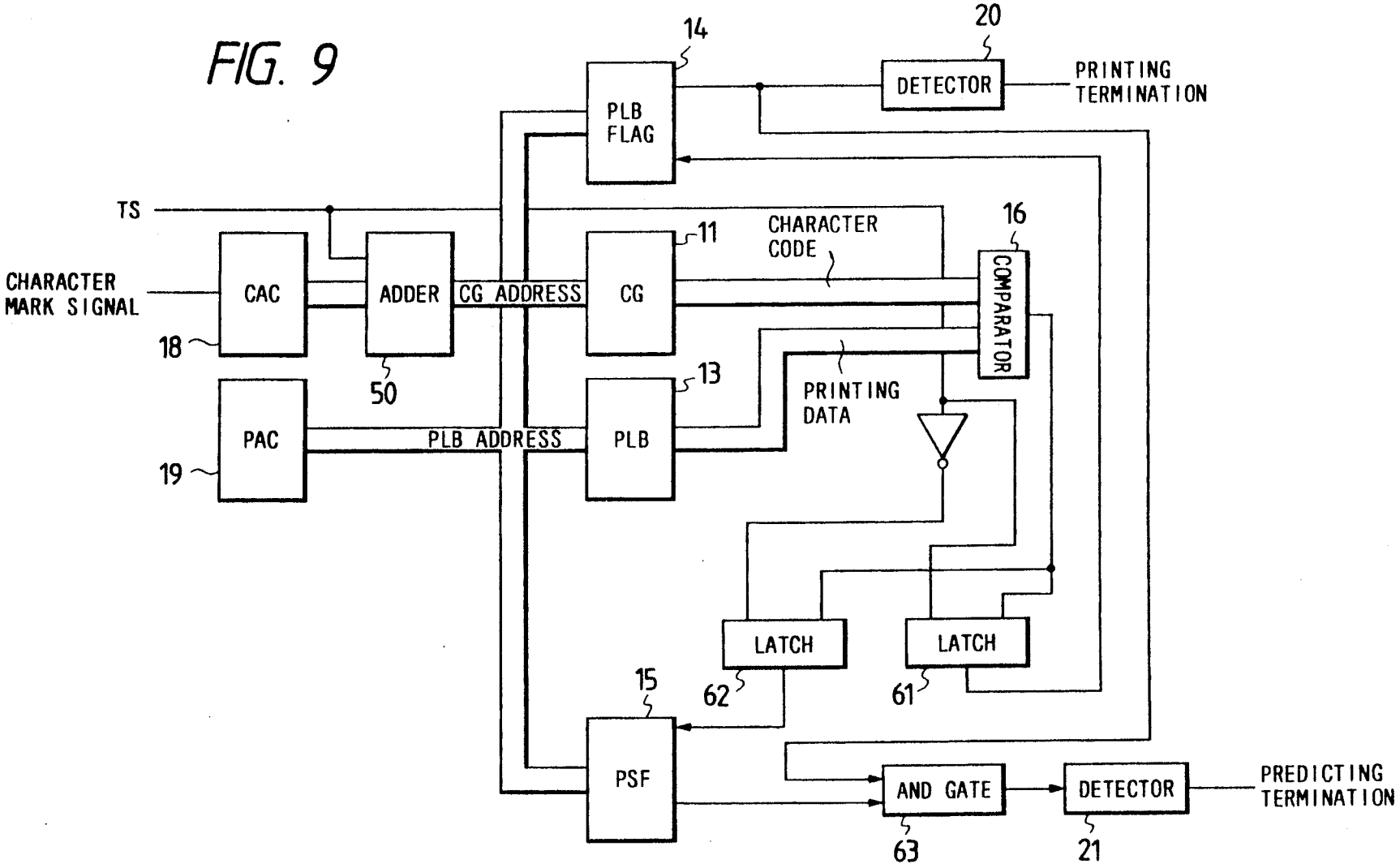

FIG. 9 shows an embodiment in which this problem is eliminated. In short, time division is used in the comparator 16 for the purpose of selecting one of real comparison with the currently opposite character and anticipatory comparison with the character X columns after the current character. Consequently, the anticipatory comparator 17 can be eliminated in the apparatus of FIG. 9. When the result of the real comparison indicates that the character and the print code accord with each other, the output signal of the comparator 16 is applied to the PLB flag 14 through a latch 61 to thereby rewrite the contents of a corresponding column of the PLB flag 14. When the result of the anticipatory comparison indicates that the character and the print code accord with each other, the output signal of the comparator 16 is applied to the PSF 15 through a latch 62 to thereby rewrite the contents of a corresponding column of the PSF 15. The output of the PLB flag 14 and the output of the PSF 15 are applied to an AND gate 63. When one of the outputs from the corresponding columns of the PLB flag 14 and the PSF 15 indicates a theoretical value "0" over all the columns thereof, the pre-scanning termination detector 21 generates a print-termination signal so that the termination of printing can be detected predictively.

According to the embodiment of FIG. 9, the anticipatory comparator 17 can be eliminated to thereby eliminate the necessity that both the character code and the print data must be fed to the anticipatory comparator 17. Consequently, the apparatus can be simplified in construction.

Although the above embodiments have been described with respect to the case where the value of X is 2, it is a matter of course that the value of X is not limited to 2 and that the value of X should be determined taking into consideration the relation between the dead time in the paper feeding system and the time required for every scanning operation.

As described above, according to the present invention, the termination of printing can be accurately predicted regardless of the pattern of the print data. Accordingly, the paper feeding cycle can be started during the printing cycle, making it possible to shorten the paper feeding cycle. Consequently, printing speed can be improved greatly.

TABLE 1

| Sub-Scan | | Hammer Column/Character Number | | | | | | | | | |
|---|---|---|---|---|---|---|---|---|---|---|---|
| 1 | Hammer Column | 1 | 6 | 11 | 16 | ... | 116 | 121 | 126 | 131 | 136 |
| | Character Number | 1 | 5 | 9 | 13 | ... | 45 | 1 | 5 | 9 | 13 |
| 2 | Hammer Column | 2 | 7 | 12 | 17 | ... | 117 | 122 | 127 | 132 | X |
| | Character Number | 2 | 6 | 10 | 14 | ... | 46 | 2 | 6 | 10 | X |
| 3 | Hammer Column | 3 | 8 | 13 | 18 | ... | 118 | 123 | 128 | 133 | X |
| | Character Number | 3 | 7 | 11 | 15 | ... | 47 | 3 | 7 | 11 | X |
| 4 | Hammer Column | 4 | 9 | 14 | 19 | ... | 119 | 124 | 129 | 134 | X |
| | Character Number | 4 | 8 | 12 | 16 | ... | 48 | 4 | 8 | 12 | X |
| 5 | Hammer Column | 5 | 10 | 15 | 20 | ... | 120 | 125 | 130 | 135 | X |
| | Character Number | 5 | 9 | 13 | 17 | ... | 1 | 5 | 9 | 13 | X |

TABLE 2

| Hammer Column | 1 | 2 | 3 | 4 | 5 | 6 | 7 | 8 | 9 | 10 |
|---|---|---|---|---|---|---|---|---|---|---|
| Print Data | C | D | G | F | H | H | I | K | M | L |
| Scan 1 | A | B | C | D | E | E | F | G | H | I |
| PLB Flag | 1 | 1 | 1 | 1 | 1 | 1 | 1 | 1 | 1 | 1 |
| Pre-Scan 1 | C | D | E | F | G | G | H | I' | J | K |
| Pre-Scan Flag | 0 | 0 | 1 | 0 | 1 | 1 | 1 | 1 | 1 | 1 |

TABLE 2-continued

| Hammer Column | 1 | 2 | 3 | 4 | 5 | 6 | 7 | 8 | 9 | 10 |
|---|---|---|---|---|---|---|---|---|---|---|
| Scan 2 | B | C | D | E | F | F | G | H | I | J |
| PLB Flag | 1 | 1 | 1 | 1 | 1 | 1 | 1 | 1 | 1 | 1 |
| Pre-Scan 2 | D | E | F | G | H | H | I | J | K | L |
| Pre-Scan Flag | 0 | 0 | 1 | 0 | 0 | 0 | 0 | 1 | 1 | 0 |
| Scan 3 | C | D | E | F | G | G | H | I | J | K |
| PLB Flag | 0 | 0 | 1 | 0 | 1 | 1 | 1 | 1 | 1 | 1 |
| Pre-Scan 3 | E | F | G | H | I | I | J | K | L | M |
| Pre-Scan Flag | 0 | 0 | 0 | 0 | 0 | 0 | 0 | 0 | 1 | 0 |
| Scan 4 | D | E | G | G | H | H | I | J | K | L |
| PLB Flag | 0 | 0 | 0 | 0 | 0 | 0 | 0 | 1 | 1 | 0 |
| Pre-Scan 4 | F | G | H | I | J | J | K | L | M | N |
| Pre-Scan Flag | 0 | 0 | 0 | 0 | 0 | 0 | 0 | 0 | 0 | 0 |

TABLE 3

| Hammer Column | 1 | 2 | 3 | 4 | 5 | 6 | 7 | 8 | 9 | 10 |
|---|---|---|---|---|---|---|---|---|---|---|
| Print Data | A | B | F | D | F | F | G | H | H | I |
| Scan 1 | A | B | C | D | E | E | F | G | H | I |
| PLB Flag | 0 | 0 | 1 | 0 | 1 | 1 | 1 | 1 | 0 | 0 |
| Pre-Scan 1 | C | D | E | F | G | G | H | I | J | K |
| Pre-Scan Flag | 1 | 1 | 1 | 1 | 1 | 1 | 1 | 1 | 1 | 1 |
| Scan 2 | B | C | D | E | F | F | G | H | I | J |
| PLB Flag | 0 | 0 | 1 | 0 | 0 | 0 | 0 | 0 | 0 | 0 |
| Pre-Scan 2 | D | E | F | G | H | H | I | J | K | L |
| Pre-Scan Flag | 1 | 1 | 0 | 1 | 1 | 1 | 1 | 1 | 1 | 1 |
| Scan 3 | C | D | E | F | G | G | H | I | J | K |
| PLB Flag | 0 | 0 | 1 | 0 | 0 | 0 | 0 | 0 | 0 | 0 |
| Pre-Scan 3 | E | F | G | H | I | I | J | K | L | M |
| Pre-Scan Flag | 1 | 1 | 0 | 1 | 1 | 1 | 1 | 1 | 1 | 1 |
| Scan 4 | D | E | F | G | H | H | I | J | K | L |
| PLB Flag | 0 | 0 | 0 | 0 | 0 | 0 | 0 | 0 | 0 | 0 |
| Pre-Scan 4 | F | G | H | I | J | J | K | L | M | N |
| Pre-Scan Flag | 1 | 1 | 0 | 1 | 1 | 1 | 1 | 1 | 1 | 1 |

What is claimed is:

1. In a line printer comprising: a character carrier adapted to continuously move along a print line; a plurality of print hammers arranged side by side along the print line so as to be in opposition to said character carrier; a code generator for storing character codes according to the arrangement of characters carried on said character carrier; a print line buffer for storing print data; a comparing means for comparing a character code supplied from said code generator with a print datum supplied from said print line buffer and for generating a print hammer drive signal when the type element code and the print datum accord with each other; and a pre-scanning flag for storing information indicating presence/absence of print data for every print hammer column when the print data is stored in said print line buffer;

a method of detecting termination of printing comprising the steps of:

performing anticipatory comparison to judge whether a character X columns after a character currently opposing one of said print hammer columns accords with the print data or not, when comparison between the character currently opposing to said one print hammer column and the print data is made by said comparing means;

rewriting contents of a corresponding column of said pre-scanning flag to indicate "absence of print data" when the step of anticipatory comparison determines that the character X columns after said character currently opposing to said one print hammer column accords with the print data; and recognizing termination of printing when all the columns of said pre-scanning flag indicate "absence of print data".

2. A print-termination detecting method according to claim 1, in which the step of anticipatory comparison is carried out by an anticipatory comparing means to judge whether a character code supplied from a predicting code generator for storing a code of a character X columns after a current character on said character carrier in an address corresponding to that of said code generator and a print datum supplied from said print line buffer accord with each other or not.

3. A print-termination detecting method according to claim 1, in which the code of the character X columns after the current character is time-divisionally read out from said code generator, and the step of anticipatory comparison is carried out by using an anticipatory comparing means to judge whether the code of the character X columns after the current character and the print data supplied from said print line buffer accord with each other or not.

4. A print-termination detecting method according to claim 1, in which the code of the character X columns after the current character is time-divisionally read out from said code generator, and the step of anticipatory comparison is time-divisionally carried out by using said comparing means to judge whether the code of the character X columns after the current character and the print data supplied from said print line buffer accord with each other or not.

5. A print-termination detecting method according to claim 1, in which X is determined taking dead time in a paper feeding system into consideration.

6. A print-termination detecting method according to claim 1, in which the step of anticipatory comparison is started before the start of a printing cycle.

7. In a line printer comprising: a character carrier adapted to continuously move along a print line; a plurality of print hammers arranged side by side along the print line so as to be in opposition to said character carrier; a code generator for storing character codes according to the arrangement of characters carried on said character carrier; a print line buffer for storing print data; a print line buffer flag and a pre-scanning flag for storing information indicating presence/absence of print data for every print hammer column when the print data is stored in said print line buffer; and a comparing means for comparing a character code supplied from said code generator with a print datum supplied from said print line buffer so as to generate a print hammer drive signal and a signal to rewrite a corresponding column of said print line buffer flag to indicate "absence of print data" when the character code and the print datum accord with each other;

a method of detecting termination of printing in said line printer comprising the steps of:

performing anticipatory comparison to judge whether a character X columns after a character currently opposing one of said print hammer columns accords with the print datum or not;

rewriting contents of a corresponding column of said pre-scanning flag to indicate "absence of print data" when the step of anticipatory comparison proves that the character X columns after said character currently opposing said one print hammer column accords with the print datum; and recognizing termination of printing when all the columns of said pre-scanning flag indicate "absence of print data".

8. A print-termination detecting method according to claim 7, in which the step of anticipatory comparison is carried out by an anticipatory comparing means to judge whether a character code supplied from a predicting code generator for storing a code of a character X columns after a current character on said character carrier in an address corresponding to that of said code generator and a print datum supplied from said print line buffer accord with each other or not.

9. A print-termination detecting method according to claim 7, in which the code of the character X columns after the current character is time-divisionally read out from said code generator, and the step of anticipatory comparison is carried out by using an anticipatory comparing means to judge whether the code of the character X columns after the current character and the print data supplied from said print line buffer accord with each other or not.

10. A print-termination detecting method according to claim 7, in which the code of the character X columns after the current character is time-divisionally read out from said code generator, and said step of anticipatory comparison is time-divisionally carried out by using said comparing means to judge whether the code of the character X columns after the current character and the print data supplied from said print line buffer accord with each other or not.

11. A print-termination detecting method according to claim 8 or 9, in which signals of said anticipatory comparing means and said comparing means for rewriting the contents of the corresponding column into "absence of print data" are subjected to ORing so that the contents of the corresponding column of the pre-scanning flag are rewritten in accordance with the result of the ORing.

12. A print-termination detecting method according to any one of claims 8, 9 and 10, in which the respective outputs of said print line buffer flag and said pre-scanning flag are subjected to ANDing by a logic circuit so that termination of printing is recognized when the output of all the columns of said print line buffer flag and said pre-scanning flag of said logic circuit indicate "absence of print data".

13. In a line printer comprising: a character carrier adapted to continuously move along a print line; a plurality of print hammers arranged side by side along the print line so as to be in opposition to said character carrier; a code generator for storing character codes according to the arrangement of characters carried on said character carrier; a print line buffer for storing print data; and a comparing means for comparing a character code supplied from said code generator with a print datum supplied from said print line buffer and for generating a print hammer drive signal when the character code and the print data accord with each other;

a print-termination detecting apparatus in said line printer, comprising:

a pre-scanning flag for storing information indicating presence/absence of print data for every print hammer column;

a predicting code generator for storing a code of a character X columns after a current character on said character carrier in an address corresponding to that of said code generator;

an anticipatory comparing means for performing anticipatory comparison between a character code supplied from said predicting code generator and a print datum supplied from said print line buffer and for generating a signal to rewrite the contents of a corresponding column of said pre-scanning flag to indicate "absence of print data" when the character code and the print data accord with each other; and a pre-scanning termination detector for detecting a print-termination signal when all the columns of said pre-scanning flag indicate "absence of print data".

14. In a line printer comprising: a character carrier adapted to continuously move along a print line; a plurality of print hammers arranged side by side along the print line so as to be in opposition to said character carrier; a code generator for storing character codes according to the arrangement of characters carried on said character carrier; a print line buffer for storing print data; a print line buffer flag for storing information indicating presence/absence of print data for every print hammer column when the print data is stored in said print line buffer; and a comparing emans for comparing a character code supplied from said code generator with a print datum supplied from said print line buffer and for generating a print hammer drive signal and a signal to rewrite the contents of a corresponding column of said pre-scanning flag to indicate "absence of print data" when the character code and the print data accord with each other;

a print-termination detecting apparatus in said line printer, comprising:

a pre-scanning flag for storing information indicating presence/absence of print data for every print hammer column;

a predicting code generator for storing a code of a character X columns after a current character on said character carrier in an address corresponding to that of said code generator;

an anticipatory comparing means for performing anticipatory comparison between a character code supplied from said predicting code generator and a print datum supplied from said print line buffer and for generating a signal to rewrite the contents of a corresponding column of said pre-scanning flag to indicate "absence of print data" when the character code and the print datum accord with each other; and a pre-scanning termination detector for detecting a print-termination signal when all the columns of said pre-scanning flag indicate "absence of print data".

15. A print-termination detecting apparatus according to claim 14, further comprising an OR gate for ORing signals of said anticipatory comparing means and said comparing means in the addresses corresponding to a column of said print hammer for rewriting the contents of the corresponding column to indicate "absence of print data" so that the contents of the corresponding column of said pre-scanning flag are rewritten based on the ORing output of said OR gate.

16. A print-termination detecting apparatus according to claim 14, further comprising a logic circuit for ANDing the respective outputs of said print line buffer flag and said pre-scanning flag so that termination of printing is recognized when the output of all the columns of said print line buffer flag and said pre-scanning flag of said logic circuit indicate "absence of print data".

17. In a line printer comprising: a character carrier continuously moving along a print line; a plurality of print hammers arranged side by side along the print line so as to be in opposition to said character carrier; a code generator for storing character codes in accordance with the arrangement of characters on said character carrier; a print line buffer for storing print data; a print line buffer flag for storing information indicating presence/absence of print data in the respective print hammer columns when print data are stored in said print line buffer; a comparing means for comparing a character code supplied from said code generator with a print datum supplied from said print line buffer and for generating a print hammer drive signal when the character code and the print datum accord with each other; and a code address counter for generating address data for making access to said code generator;

a print-termination detecting apparatus comprising:

a pre-scanning flag for storing information indicating presence/absence of print data corresponding to the respective print hammer columns;

an adder provided between said code address counter and said code generator so as to operate based on a time-division signal generated in a predetermined period in a printing cycle in a manner so that said adder outputs an address datum of said code address counter as it is or outputs a value obtained by adding a predetermined number X to an address datum provided by said code address counter;

an anticipatory comparing means for performing anticipatory comparison to judge whether a character code generated from said code generator at the time when said adder has performed the addition of said predetermined number X accords with a print datum supplied from said print line buffer or not and for generating a signal to rewrite the contents of a corresponding column of said pre-scanning flag when the character code and the print datum accord with each other; and a pre-scanning termination detector for generating a print-termination signal when all the columns of said pre-scanning flag indicate "absence of print data".

18. In a line printer comprising: a character carrier continuously moving along a print line; a plurality of print hammers arranged side by side along the print line so as to be in opposition to said character carrier; a code generator for storing character codes in accordance with the arrangement of characters on said character carrier; a print line buffer for storing print data; a print line buffer flag for storing information indicating presence/absence of print data in the respective print hammer columns when print data are stored in said print line buffer; a comparing means for comparing a character code supplied from said code generator with a print datum supplied from said print line buffer and for generating a print hammer drive signal when the character code and the print datum accord with each other; and a code address counter for generating address data for making access to said code generator;

a print-termination detecting apparatus comprising:

an adder provided between said code address counter and said code generator so as to operate based on a time-division signal generated in a predetermined period in a printing cycle in a manner so that said adder outputs an address datum of said code address counter as it is or outputs a value obtained by adding a predetermined number X to an address datum provided by said code address counter;

a pre-scanning flag for storing information indicating presence/absence of print data corresponding to the respective print hammer columns, said pre-scanning flag being arranged so that the contents of a corresponding column of said pre-scanning flag are rewritten to indicate "absence of print data" based on a signal generated from said comparing means for performing anticipatory comparison to judge whether a character code supplied from said code generator accords with a print datum supplied from said print line buffer at the time when said adder has performed the addition of said predetermined number; and a pre-scanning termination detector for generating an print-termination signal when all the columns of said pre-scanning flag indicate "absence of print data".

* * * * *